US006257001B1

(12) United States Patent
Muldowney et al.

(10) Patent No.: US 6,257,001 B1
(45) Date of Patent: Jul. 10, 2001

(54) CRYOGENIC VACUUM PUMP TEMPERATURE SENSOR

(75) Inventors: Francis Muldowney, Danielsville; Eric Regis Schall, Whitehall, both of PA (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/382,309

(22) Filed: Aug. 24, 1999

(51) Int. Cl.[7] ..... B01D 8/00
(52) U.S. Cl. ..... 62/55.5; 62/125; 62/129
(58) Field of Search ..... 62/55.5, 125, 129; 417/32; 415/118

(56) References Cited

U.S. PATENT DOCUMENTS

| | | | | |
|---|---|---|---|---|
| 2,032,158 | * | 2/1936 | Weaver | 62/125 |
| 3,135,099 | * | 6/1964 | Holm | 62/129 |
| 3,913,341 | * | 10/1975 | Katsuta | 62/129 |
| 4,588,955 | * | 5/1986 | Anderson | 328/233 |
| 4,608,866 | * | 9/1986 | Berquist | 62/55.5 |
| 4,659,988 | * | 4/1987 | Goff et al. | 415/118 |
| 4,679,401 | * | 7/1987 | Lessard et al. | 62/55.5 |
| 4,718,240 | * | 1/1988 | Andeen et al. | 62/55.5 |
| 4,757,689 | * | 7/1988 | Bachler et al. | 62/55.5 |
| 4,818,327 | * | 4/1989 | Davis et al. | 156/345 |
| 4,918,930 | | 4/1990 | Gaudet et al. . | |
| 4,958,499 | * | 9/1990 | Haefner et al. | 62/55.5 |
| 5,001,903 | * | 3/1991 | Lessard et al. | 62/55.5 |
| 5,157,928 | | 10/1992 | Gaudet et al. . | |
| 5,343,708 | | 9/1994 | Gaudet et al. . | |
| 5,386,708 | * | 2/1995 | Kishorenath et al. | 62/55.5 |
| 5,400,604 | * | 3/1995 | Hafner et al. | 62/55.5 |
| 5,436,790 | * | 7/1995 | Blake et al. | 361/234 |
| 5,444,597 | * | 8/1995 | Blake et al. | 361/234 |
| 5,450,316 | | 9/1995 | Gaudet et al. . | |
| 5,582,017 | * | 12/1996 | Noji et al. | 62/55.5 |
| 5,778,682 | * | 7/1998 | Ouellet | 62/55.5 |
| 5,806,319 | * | 9/1998 | Wary et al. | 62/55.5 |
| 5,951,834 | * | 9/1999 | Satoh | 204/298.03 |

FOREIGN PATENT DOCUMENTS

| | | | | |
|---|---|---|---|---|
| 405052196 | * | 3/1993 | (JP) | 417/32 |

* cited by examiner

*Primary Examiner*—Ronald Capossela
(74) *Attorney, Agent, or Firm*—Duane Morris & Heckscher LLP; Steven E. Koffs

(57) ABSTRACT

An assembly includes a temperature sensor having an operating range that includes a normal operating temperature of a cryogenic vacuum pump and a temperature of the pump following a dump. The assembly may be included in a semiconductor processing apparatus for performing an implant operation on a wafer. The apparatus includes: a chamber containing a wafer; an ion source that provides ions to be implanted in the wafer; a cryogenic vacuum pump that maintains a vacuum in the chamber; and a temperature sensor having an operating range that includes a normal operating temperature of the pump and a temperature of the pump following a dump. A circular mounting bracket may be used to mount the temperature sensor on an exterior surface of the pump. An alarm may be activated when the sensed temperature indicates that a dump condition exists. An inert gas, such as nitrogen, may be introduced into the semiconductor wafer processing apparatus when the sensed temperature indicates that a dump condition exists.

23 Claims, 3 Drawing Sheets

CRYOGENIC VACUUM PUMP TEMPERATURE SENSOR

FIELD OF THE INVENTION

The present invention relates to pumps generally, and more specifically to cryogenic vacuum pumps.

DESCRIPTION OF THE RELATED ART

Cryogenic vacuum pumps (also referred to herein as cryopumps) provide clean, reliable, high-speed pumping for critical vacuum process applications. Exemplary cryopumps are manufactured by the CTI Cryogenics division of Helix Technology Corp., Mansfield, Md. Cryopumps are also described in U.S. Pat. Nos. 4,918,930, 5,157,928, 5,343,708 and 5,450,316, which are expressly incorporated by reference herein in their entireties.

A common use for cryopumps is in ion implantation processes and sputtering which are frequently used in semiconductor fabrication. A cryopump can be used to achieve a vacuum on the order of $5\times10^{-6}$ Torr, which is important for implantation processes.

Cryopumps are typically designed to operate only at very low pressures, and do not operate properly under ambient conditions. Therefore, a cryopump is typically operated in conjunction with a roughing pump. The roughing pump reduces the pressure in the system to a pressure of about 3 to $4\times10^{-3}$ Torr, which is sufficiently low for the cryopump to operate.

In a typical semiconductor fabrication process, wafers are processed within a chamber. A valve connecting the cryopump to the chamber remains closed while the wafer is placed in the chamber. The chamber is closed and the roughing pump is used to reduce pressure within the chamber to a vacuum level suitable for operating the cryopump. The valve separating the cryopump from the chamber is then opened, to pump out the chamber to the degree of vacuum required for processing. The process may, for example, include the implantation of ions (e.g., arsenic, phosphorus, or boron) into the wafer. The ions are contained in a carrier gas, typically hydrogen.

In certain circumstances, the cryopump may be inadvertently exposed to atmospheric air. This may occur, for example, if a valve separating the cryopump from the chamber opens at the wrong time, or if the valve fails. When this occurs, the cryopump "dumps". When the cryopump dumps, it can neither maintain the desired pressure or cryogenic temperature for its normal operation. Ice forms within the cryopump. Hydrogen from the carrier gas collects within the vacuum vessel of the cryopump. A significant risk exists that a spark may be introduced into the vessel and ignite the hydrogen.

For example, some cryopumps may have an ion tube in the vessel (either factory mounted, or installed by the user) for the purpose of measuring the vacuum pressure. Activating the ion tube when the cryopump dumps can cause a spark that ignites the hydrogen in the vacuum vessel of the cryopump. This results in an explosion within the vacuum vessel of the cryopump. This presents risk to personnel, and may result in substantial costs and processing schedule delays.

SUMMARY OF THE INVENTION

One aspect of the present invention is an assembly including a temperature sensor having an operating range that includes a normal operating temperature of a cryogenic vacuum pump and a temperature of the pump following a dump. A mounting bracket is capable of mounting the temperature sensor on the pump.

Another aspect of the invention is a semiconductor processing. apparatus including: a chamber containing a wafer; an ion source that provides ions to be implanted in the wafer; a cryogenic vacuum pump that maintains a vacuum in the chamber; and a temperature sensor having an operating range that includes a normal operating temperature of the pump and a temperature of the pump following a dump, the temperature sensor being mounted on the pump.

An additional aspect of the invention is a method including sensing a temperature of a cryogenic vacuum pump; and activating an alarm when the sensed temperature indicates that a dump condition exists.

Still another aspect of the invention is a semiconductor wafer produced by a method including: sensing a temperature of an exterior surface of a cryogenic vacuum pump; using the pump to form a vacuum in a semiconductor wafer processing apparatus for performing an implant operation on the wafer; and introducing an inert gas into the semiconductor wafer processing apparatus when the sensed temperature indicates that a dump condition exists.

DETAILED DESCRIPTION

Figure 1:
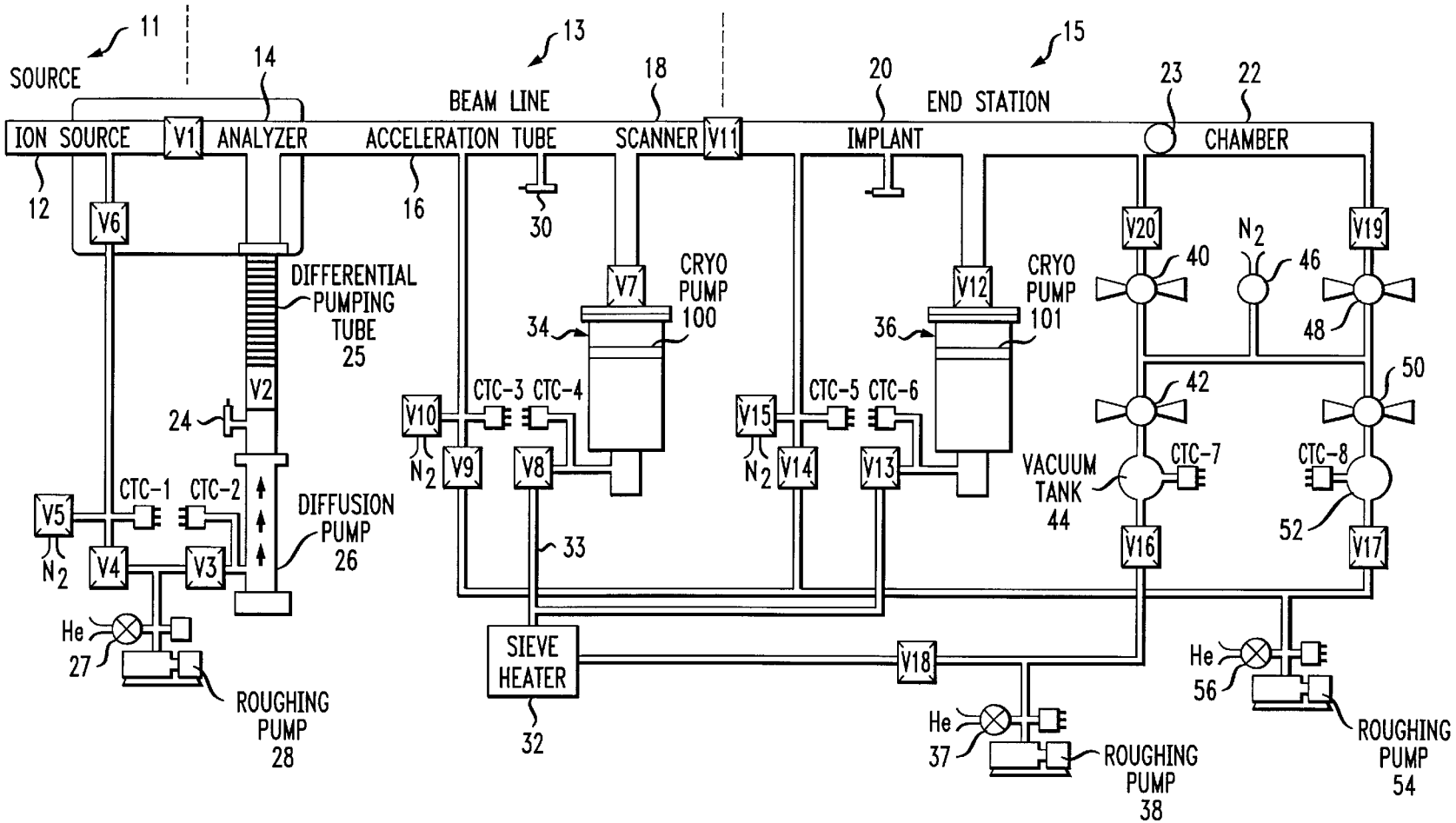
FIG. 1 is a block diagram of a semiconductor processing system including an exemplary embodiment of the invention.

FIG. 1 is a block diagram of an exemplary semiconductor processing apparatus 10 according to the invention. The apparatus 10 includes a chamber 22 containing a wafer 23. An ion source 12 provides ions to be implanted in the wafer 23. The chamber 22 and ion source 12 are connected by an analyzer 14, acceleration tube 16, and scanner 18. The analyzer 14, acceleration tube 16 and scanner 18 are collectively referred to as the "beam line" 13. Within the beam line 13, the ions within the gas from ion source 12 are accelerated towards the wafer 23, to be implanted in the wafer surface. The implant zone 20 and chamber 22 are collectively referred to as the "end station" 15. At least one cryogenic vacuum pump 100, 101 maintains a vacuum in the end station 15.

In the exemplary embodiment, the source 11 and beam line 13 are separated by a valve V1. The beam line 13 and end station 15 are separated by a valve V11. Three roughing pumps 28, 38 and 54 are used to reduce the pressure in the source 11, beam line 13 and end station 15, respectively. A plurality of valves V2–V10 and V12–V20 are used to isolate various parts of the system from each other, either during normal implantation processing, or during trouble shooting.

Two cryopumps 34 and 36 are provided for maintaining a high degree of vacuum in the system. Cryopumps 34 and 36 have respective sensor assemblies 100 and 101, described further below. Each cryopump 34 and 36 has a respective valve V7 and V12 that is normally opened during implantation processing.

Adjacent the analyzer 14, a diffusion pump 24 and differential pumping tube 25 provide the vacuum for the source 11 and analyzer regions. The differential pumping tube 25 provides voltage isolation, to isolate the diffusion pump 26 from the high voltage end of the system.

Two vacuum tanks 44 and 52 are provided proximate to the chamber 22. The vacuum tanks 44, 52 are connected to respective roughing pumps 38 and 54. Two pairs of valves 40 and 42, 48 and 50 provide a manifold for rapidly depressurizing the chamber after a wafer is inserted. The vacuum tanks 44, 52 are evacuated. When the valves coupling the vacuum tanks to the chamber 22 are opened, the gas is quickly drawn out of the chamber and into the vacuum tanks 44, 52. Vacuum tank 44 and valves 40 and 42 provide the quick rough vacuum, and vacuum tank 52 and valves 48 and 50 provide the final rough vacuum.

Adjacent each roughing pump 28, 38, 54 is a respective valve 28, 37, 56 for admitting helium into the system. The helium is not used for normal implantation processing, but may be introduced into the system for locating a leak in the system.

A plurality of thermocouples CTC-1 through CTC-8 are used to measure the vacuum at various locations within the system, including source 11, diffusion pump 26, acceleration tube 16, cryopump 34, implant zone 20, cryopump 36, vacuum tank 44 and vacuum tank 52, respectively.

Four valves V5, V10, V 15 and 46 connect the system to a source of an inert gas. In the event of a dump, it is desirable to pump the inert gas into the system as quickly as possible, to displace the hydrogen that builds up in the cryopumps 34, 36. In the exemplary embodiment, the inert gas is nitrogen. Other inert gases may also be used.

In the normal configuration for an implant operation, the exemplary system is used with the following valves open: V1, V2, V3, V7, V11, V12. The remaining valves are closed while the implant operation is being performed.

The exemplary system also includes two track lock valves (not shown) isolating the wafer 23 from the end station 15.

A sieve heater 32 may optionally be used to heat up the line 33.

Figure 2:
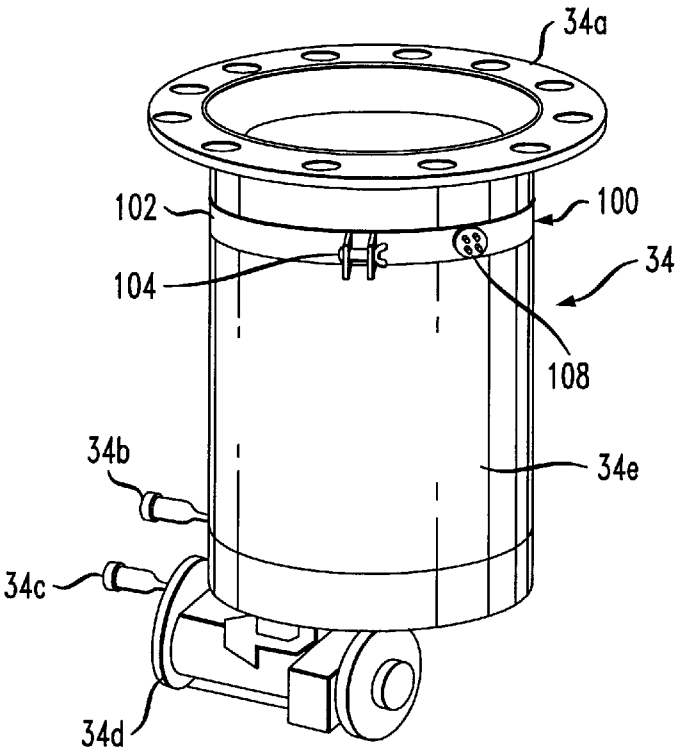
FIG. 2 is an isometric view of an exemplary cryopump with an assembly according to the invention mounted on its exterior surface.

FIG. 2 is an isometric view of one of the cryopumps 34. The exemplary cryopump 34 is model No. "Cryo Torr 8", manufactured by CTI-Cryogenics of Mansfield Mass. Cryopump 34 has a mounting flange 34*a*, a gas supply connection 34*b*, a gas return connection 34*c*, and a drive motor 34*d*. Cryopump 34 has a vacuum vessel 34*e* having an exterior surface. An assembly 100 is mounted on the exterior surface of vessel 34*e*, using a mounting bracket 102.

The inventors have observed that, when the cryopump 34 dumps, the temperature of the exterior surface of vessel 34*e* of the cryopump drops significantly. An assembly 100 is mounted on the vessel 34*e*. Assembly 100 includes a temperature sensor 110 having an operating range that includes a normal operating temperature of a cryogenic vacuum pump 34 and a temperature of the pump following a dump. In the exemplary embodiment, the sensor is capable of operating in a range between about 32° F. and about 65° F. The sensor is described in greater detail below.

Figure 3:
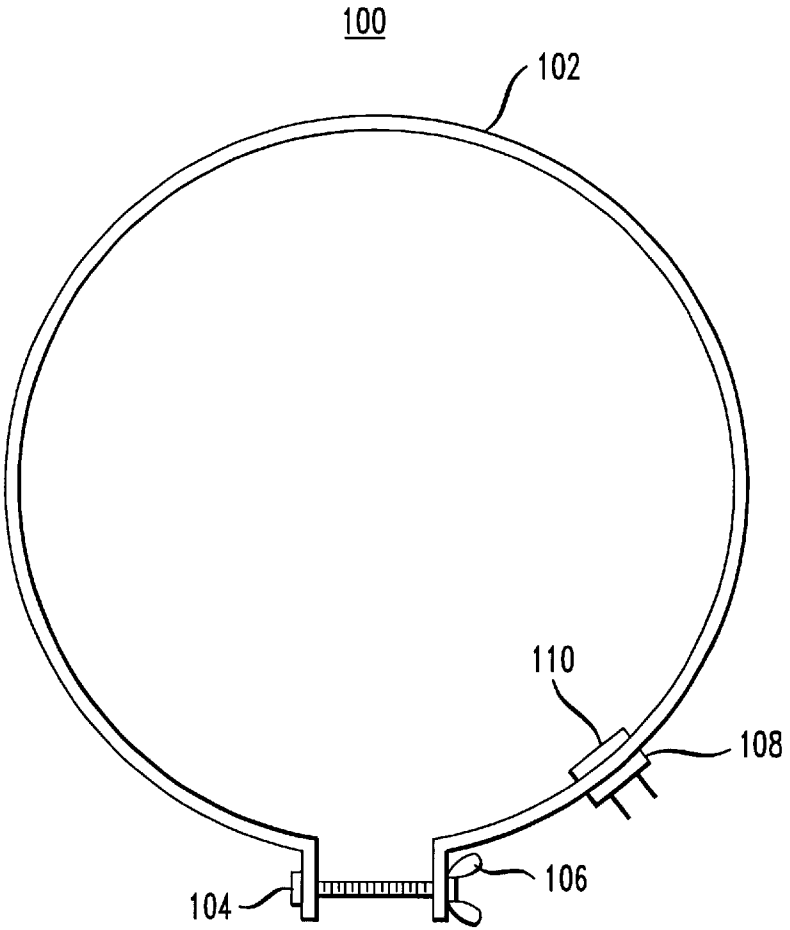
FIG. 3 is a plan view of the sensor assembly shown in FIG. 2.

FIG. 3 shows the exemplary assembly 100. The exemplary mounting bracket 102 of assembly 100 is shaped to fit around the exterior surface of the vacuum vessel 34*e* of the pump 34. The exemplary mounting bracket 102 is substantially circular.

Figure 4:
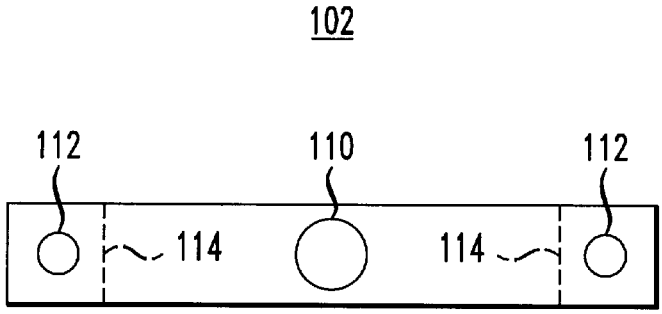
FIG. 4 is an elevation view of the mounting bracket shown in FIG. 3, prior to bending.

FIG. 4 is an elevation view of the bracket 102 prior to being bent into the circular shape. As shown in FIG. 4, the bracket 102 has a central hole 110 shaped to receive the temperature sensor 108. Although the exemplary sensor 108 is round, a variety of sensors may be substituted. Bracket 102 may be modified to accommodate differently shaped sensors. The exemplary bracket 102 has two end portions 114, each having a hole 112 drilled therethrough. The exemplary assembly 102 has a fastener 104 that is passed through the holes 114 to secure the ends together, so as to tightly grip the exterior surface of the vacuum vessel 34*e*. Exemplary fastener 104 is a bolt, tightened by a wing nut 106. A variety of other fastener types may be used. The bracket 102 may be formed from a variety of materials, such as stainless steel. Preferably, the bracket material has a high thermal conductivity.

The exemplary sensor assembly 100 is suitable for retrofitting to an existing cryopump 34 that does not have a sensor suitable for detecting a dump condition. The invention may alternatively be practiced by incorporating a sensor mount and/or a sensor into the appropriate position on the cryopump, so as to eliminate the externally supplied sensor assembly 100. A variety of integrally attached sensor mounts may be readily constructed by those of ordinary skill in the art.

The exemplary temperature sensor 108 is a precision snap disk thermostat, series 08-01, manufactured by the Kidde-Fenwal, Inc., Ashland, Mass. The thermostat 108 closes when the temperature of the pump (as measured by the thermostat) indicates a dump condition. Based on the empirically measured temperature profile of the exemplary CTI-Cryogenics "Cryo Torr 8" cryopump 34 during normal operations and during a dump, the thermostat 108 is selected to close when the exterior surface temperature of vessel 34*e* reaches 55° F. and open when the temperature reaches 65° F. If other types of cryopumps are used, the appropriate opening and closing temperatures for the thermostat 108 may be easily measured empirically.

Figure 5:
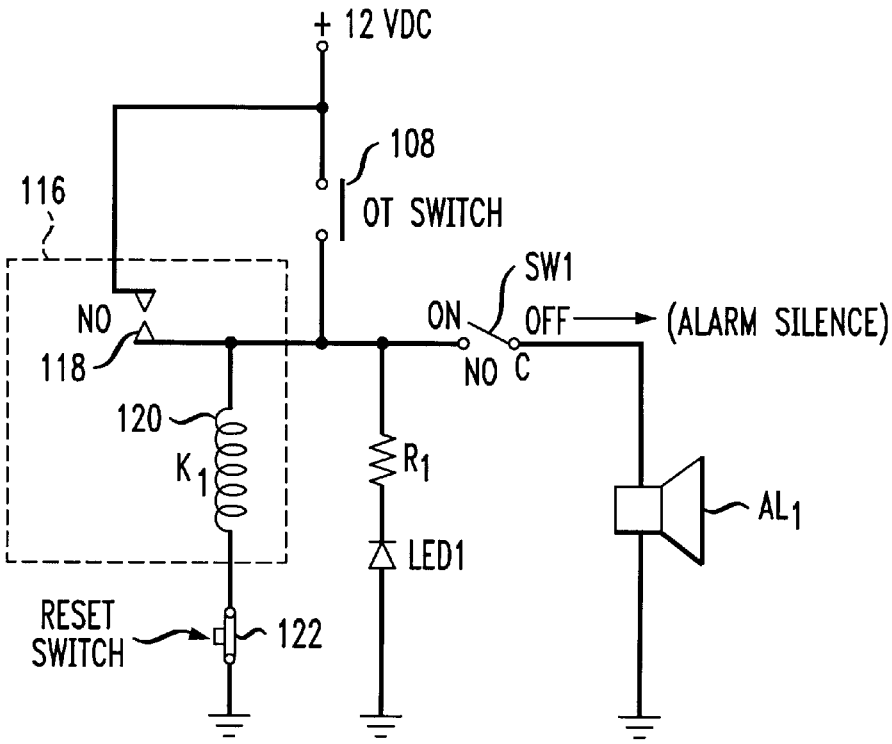
FIG. 5 is a schematic diagram of the circuit connected to the sensor shown in FIGS. 2 and 3.

FIG. 5 is a schematic diagram of an alarm system which includes the thermostat 108. The main components of the alarm system are the thermostat 108, a relay 116 (which may be a 712 DPDT basic relay manufactured by Teledyne Relays, Hawthorne, Calif.), a visible alarm (which may be a light emitting diode, LED1) and an audible alarm AL1 (which may be the Sonalert PK-20A35EW alarm manufactured by the Mallory North American Capacitor Company, Indianapolis, Ind.). As noted above, the thermostat 108 closes when the temperature of vessel 34*e* reaches 55° F. and opens when the temperature reaches 65° F. This is the temperature range associated with a dump condition. The relay 116 acts as a latch. When the thermostat 108 closes, the contacts 118 of relay 116 close, forming a conductive path. Power is provided to the visible alarm LED1 and the audible alarm AL1. The alarms continue until the reset switch 122 is manually actuated. Thus, even if the temperature returns to 65° F. and the thermostat opens, relay 116 continues to provide a signal path to conduct electricity to the alarms. A switch SW1 is provided to allow the user to optionally disconnect the audible alarm AL1, so that only the visible alarm LED1 is used. The latching function is desirable to keep the alarm sounding until the operator attends to the system (for example, by introducing nitrogen into the cryopump 34 or 36).

FIG. 5 shows only a single alarm system. The exemplary system 10 includes a second alarm system identical to that shown in FIG. 5. One alarm is connected to the sensor assembly 100 of cryopump 34, and the other alarm is connected to the sensor assembly 101 of cryopump 36.

Although the exemplary alarm system uses a thermostat and a relay, a variety of circuits may be used to provide an alarm function. For example, the circuit may be implemented without the latching function provided by the relay, so that the alarms automatically shut off when the temperature of the vessel 34*e* returns to its normal range.

In other variations of the exemplary embodiment, a temperature sensor other than a thermostat may be used. For example, a thermistor or other transducer that outputs a signal representative of temperature may be fed to a processor. The processor may activate an alarm whenever the temperature falls outside of the desired range.

Although the exemplary embodiment uses the exterior temperature of the vacuum vessel of the cryopump to determine the existence of a dump condition, other indicators, such as interior temperature or pressure of the cryopump may be used.

An exemplary method according to the invention may include the following steps. A temperature sensor is mounted to the exterior surface of the pump. The temperature of a cryogenic vacuum pump is sensed with the sensor. The temperature may be sensed, for example, when the cryopump is being used to form a vacuum in a semiconductor processing apparatus for performing an implant operation on the wafer. An alarm is activated when the sensed temperature indicates that a dump condition exists.

Preferably, when the sensed temperature indicates that a dump condition exists, the method further includes the step of providing an inert gas (such as nitrogen or a noble gas) to the pump.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. An assembly comprising:

a cryogenic vacuum pump:

a temperature sensor having an operating range that includes a normal operating temperature of the cryogenic vacuum pump and a temperature of the pump following a dump; and a mounting bracket capable of mounting the temperature sensor on the pump.

2. The assembly of claim 1, wherein the mounting bracket mounts the sensor to an exterior surface of the pump.

3. The assembly of claim 1, wherein the sensor is capable of operating in a range between about 55° F. and about 65° F.

4. The assembly of claim 1, wherein the mounting bracket is substantially circular.

5. The assembly of claim 1, wherein the mounting bracket is shaped to fit around a vacuum vessel of the pump.

6. The assembly of claim 1, wherein the temperature sensor is a thermostat that closes when the temperature of the pump indicates a dump condition.

7. The assembly of claim 6, further comprising an alarm that is activated when the temperature of the pump indicates a dump condition.

8. The assembly of claim 7, wherein the alarm is one of the group consisting of an audible alarm and a visible alarm.

9. The assembly of claim 7, further comprising a relay that activates the alarm when the thermostat closes.

10. The assembly of claim 1, further comprising:

an alarm that is activated when the temperature of the pump indicates a dump condition; and a relay that activates the alarm;

and wherein the mounting bracket is shaped to fit around a vacuum vessel of the pump and mounts the sensor to an exterior surface of the pump, and wherein the mounting bracket has a fastener for gripping the exterior of the vacuum pump, and wherein the sensor is a thermostat that closes when the temperature of the pump indicates a dump condition and is capable of operating in a range between about 32° and about 65° F., and wherein the relay activates the alarm when the thermostat closes.

11. The assembly of claim 10, further comprising a reset switch attached to the relay, wherein the relay acts as a latch, and wherein the reset switch is manually actuated to shut off the alarm.

12. The assembly of claim 10, wherein the at least one alarm automatically shuts off when the thermostat senses that the exterior of the cryopump is at a normal operating range.

13. The assembly of claim 10, wherein the mounting bracket is substantially circular.

14. Semiconductor processing apparatus comprising:

a chamber containing a wafer;

an ion source that provides ions to be implanted in the wafer;

a cryogenic vacuum pump that maintains a vacuum in the chamber; and a temperature sensor having an operating range that includes a normal operating temperature of the pump and a temperature of the pump following a dump; and a mounting bracket capable of mounting the temperature sensor on the pump.

15. The apparatus of claim 14, wherein the mounting bracket mounts the temperature sensor to the exterior surface of the pump.

16. The assembly of claim 14, further comprising an alarm that is activated when the temperature sensor senses a temperature indicating a dump condition.

17. The apparatus of claim 16, further comprising a source of an inert gas for introducing inert gas into the pump when the temperature sensor indicates a dump condition.

18. A method comprising the steps of:

sensing a temperature of a cryogenic vacuum pump; and activating an alarm when the sensed temperature indicates that a dump condition exists.

19. The method of claim 18, further comprising the step of:

using the pump to form a vacuum in a semiconductor wafer processing apparatus.

20. The method of claim 18, further comprising the step of:

mounting a temperature sensor to the exterior surface of the pump prior to performing the sensing step.

21. The method of claim 18, further comprising the step of providing an inert gas to the pump when the sensed temperature indicates that a dump condition exists.

22. A semiconductor wafer produced by a method comprising the steps of:

sensing a temperature of an exterior surface of a cryogenic vacuum pump;

using the pump to form a vacuum in a semiconductor wafer processing apparatus for performing an implant operation on the wafer; and introducing an inert gas into the semiconductor wafer processing apparatus when the sensed temperature indicates that a dump condition exists.

23. The wafer of claim 22, wherein the inert gas is nitrogen.

* * * * *

UNITED STATES PATENT AND TRADEMARK OFFICE

CERTIFICATE OF CORRECTION

PATENT NO. : 6,257,001 B1
DATED : July 10, 2001
INVENTOR(S) : Francis Muldowney and Eric Regis Schall It is certified that error appears in the above-identified patent and that said Letters Patent is hereby corrected as shown below:

Column 5,
Line 42, delete "capable of mounting" and insert therefor -- , wherein the mounting bracket mounts --

Column 6,
Line 28, delete "capable of mounting" and insert therefor -- , wherein the mounting bracket mounts --

Signed and Sealed this

Nineteenth Day of March, 2002

*Attest:*

*Attesting Officer*

JAMES E. ROGAN
*Director of the United States Patent and Trademark Office*